US009702169B2

(12) United States Patent
McNeil

(10) Patent No.: US 9,702,169 B2
(45) Date of Patent: Jul. 11, 2017

(54) MULTIPLE PADLOCK LOCKING SYSTEM

(71) Applicant: Randy L. McNeil, Estes Park, CO (US)

(72) Inventor: Randy L. McNeil, Estes Park, CO (US)

( * ) Notice: Subject to any disclaimer, the term of this patent is extended or adjusted under 35 U.S.C. 154(b) by 183 days.

(21) Appl. No.: 14/837,132

(22) Filed: Aug. 27, 2015

(65) Prior Publication Data

US 2017/0058581 A1 Mar. 2, 2017

(51) Int. Cl.

| | |
|---|---|
| ***E05C 17/04*** | (2006.01) |
| ***E05B 67/38*** | (2006.01) |
| ***E05B 63/14*** | (2006.01) |
| *E05B 65/00* | (2006.01) |

(52) U.S. Cl.

CPC ..... *E05B 67/383* (2013.01); *E05B 63/143* (2013.01); *E05B 65/0007* (2013.01)

(58) Field of Classification Search

CPC .... E05B 67/383; E05B 65/0007; E05B 35/05; E05B 63/18; Y10T 292/1025; Y10T 292/1086; Y10T 70/413; Y10T 70/5726; Y10T 70/5779; Y10S 70/63

USPC ..... 292/277

See application file for complete search history.

(56) References Cited

U.S. PATENT DOCUMENTS

| | | | | |
|---|---|---|---|---|
| 3,603,629 | A | 9/1971 | Windham | |
| 4,185,860 | A | 1/1980 | Bondi | |
| D267,698 | S | 1/1983 | Domes | |
| D268,478 | S | 4/1983 | Domes | |
| 5,127,244 | A | 7/1992 | Myers | |
| 5,261,258 | A | 11/1993 | Bunger | |
| 5,345,794 | A | 9/1994 | Jenks | |
| 5,868,015 | A * | 2/1999 | Eaker | E05B 67/383 292/148 |
| 6,367,292 | B1 | 4/2002 | Bunger | |
| 7,690,229 | B2 * | 4/2010 | McKee | E05B 67/383 292/148 |
| 7,918,111 | B2 | 4/2011 | Uliano | |

* cited by examiner

*Primary Examiner* — Mark Williams
(74) *Attorney, Agent, or Firm* — Ancel W. Lewis, Jr.

(57) ABSTRACT

A locking system has a base, a receiver, a bolt assembly and at least one link member. The bolt assembly has a bolt that slides through the link members and the base, and into the receiver. The bolt assembly has an end plate with a padlock tab that projects through a slot in a plate on the link member. Each link member has another plate with a padlock tab that can projects through a slot in a plate on the base or a slot on an adjacent link member. The padlock tabs each have a padlock aperture for a padlock or a puck lock. Removal of a lock allows a user to slide the bolt out of the receiver.

14 Claims, 2 Drawing Sheets

MULTIPLE PADLOCK LOCKING SYSTEM

TECHNICAL FIELD

The present invention relates to locking devices, and more particularly to a locking system for use with multiple padlocks.

BACKGROUND ART

Multiple lock systems are used to allow access to an area by multiple users while preventing access to unauthorized persons. Such systems may be used, for example, on property with oil and gas leases, hunting leases, or wireless communications towers. One advantage of multiple lock systems over a single lock system is that a user authorized to access multiple areas may use locks with the same key for each area, eliminating the need for that user to carry multiple keys and reducing confusion over which key provides access to which area. Another advantage is that when a user is no longer authorized to access the area, the user's lock can be replaced or eliminated, and the distribution of new keys to all of the other users is not required.

One simple prior known multiple lock system uses a chain around a gatepost and a post on a gate secured by multiple padlocks linked in series with each user having their own padlock and key. One disadvantage of this system is that a user may bypass one or more locks when resecuring the chain, thereby preventing access to the users of the bypassed locks. Another disadvantage is that one user can remove the whole system. Detection of an unauthorized lock, added by cutting the chain and inserting the lock, is very difficult with this system.

U.S. Pat. No. 7,503,194 to the present applicant discloses a multiple padlock system with links that encircle a gatepost and links that encircle a post on a gate. This system and the chain system described above generally require an accessible gatepost and an accessible post on the gate. U.S. Pat. No. 6,857,299 to the present applicant discloses a multiple padlock system with a plurality of push bolts that each accept a padlock, and a sliding bar that is released by removing a padlock and pressing the associated push bolt. The number of push bolts can be easily changed by a master user, and the system can be used with almost any type of gate and with doors.

A puck lock is a shackleless lock with a puck shaped body, a slot through the body and a retractable plunger that extends through the slot. Examples of puck locks are disclosed in U.S. Pat. No. 5,345,794 to Jenks and U.S. Pat. No. 7,918,111 to Uliano. Puck locks may be more secure than padlocks with shackles that can be cut with bolt cutters. Puck locks do not work with most or all of the prior known multiple locks systems.

DISCLOSURE OF THE INVENTION

A locking system for use with multiple padlocks includes a base, a receiver, a bolt assembly, and one or more link members. The base has a base mounting portion for mounting on a gatepost or a gate, a base tube attached to the base mounting portion and three laterally spaced, parallel base plates that project transversely from the base tube. Each of the outer base plates has an elongated slot. The receiver includes a receiver mounting portion for mounting on a gatepost or a gate, and a receiver tube attached to the receiver mounting portion. The bolt assembly has an elongated bolt and a transversely projecting end plate at one end of the bolt. The end plate includes a projecting padlock tab with a padlock aperture. The bolt is sized and shaped to slide through the base tube and into the receiver tube. Each link member has a link tube sized and shaped to slide on the bolt, and two laterally spaced, parallel link plates that project transversely from the link tube. One link plate includes an elongated slot and the other link plate includes a laterally outwardly projecting padlock tab with a padlock aperture. The system is assembled with the link members between the base and the end plate of the bolt. The slots on the base and link members are sized and positioned to receive the padlock tabs on the bolt and link members. The padlock tabs and padlock apertures on the bolt and link members are sized to receive a puck lock or a padlock.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
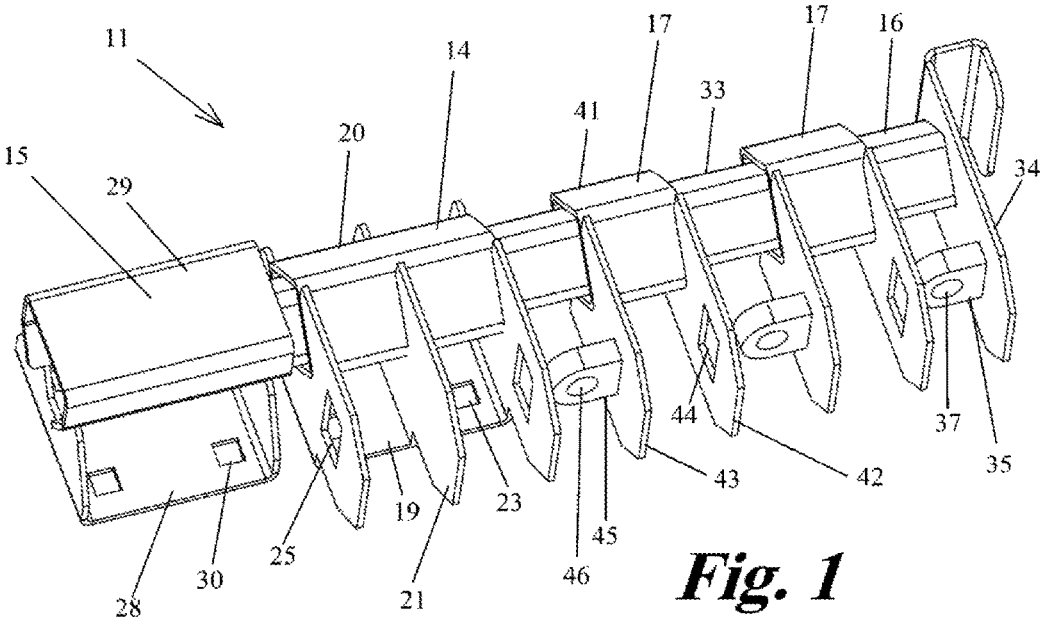
FIG. 1 is a perspective view of a locking system, embodying features of the present invention.
Figure 2:
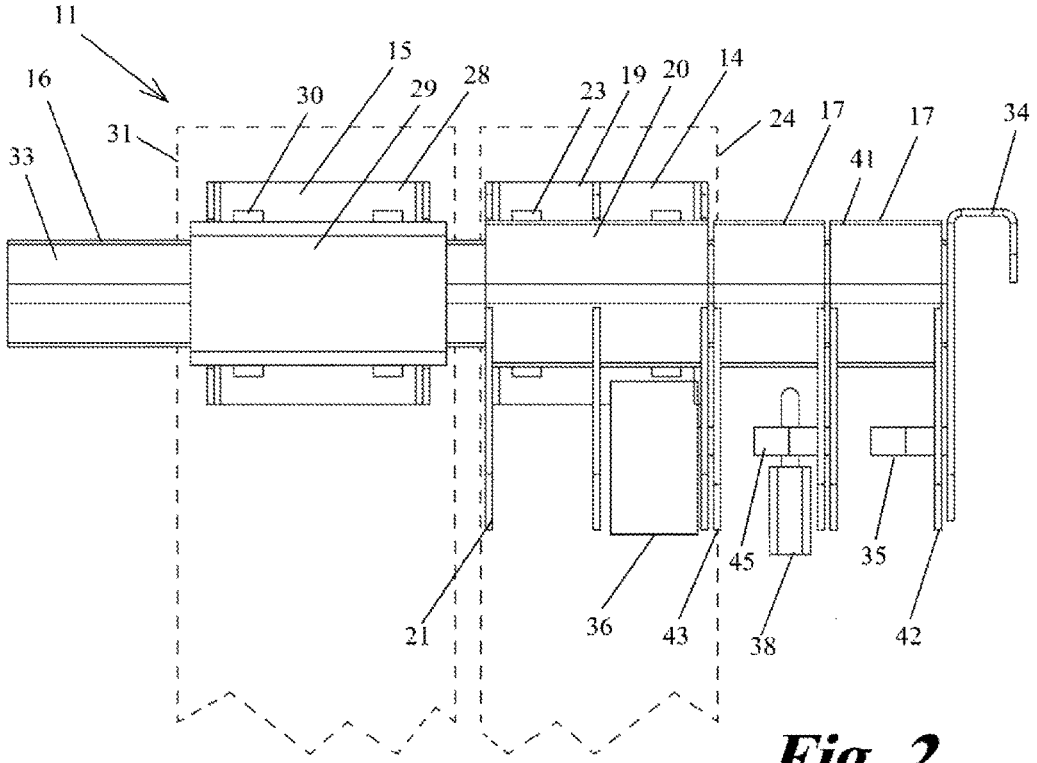
FIG. 2 is a front elevation view of the locking system of FIG. 1.
Figure 3:
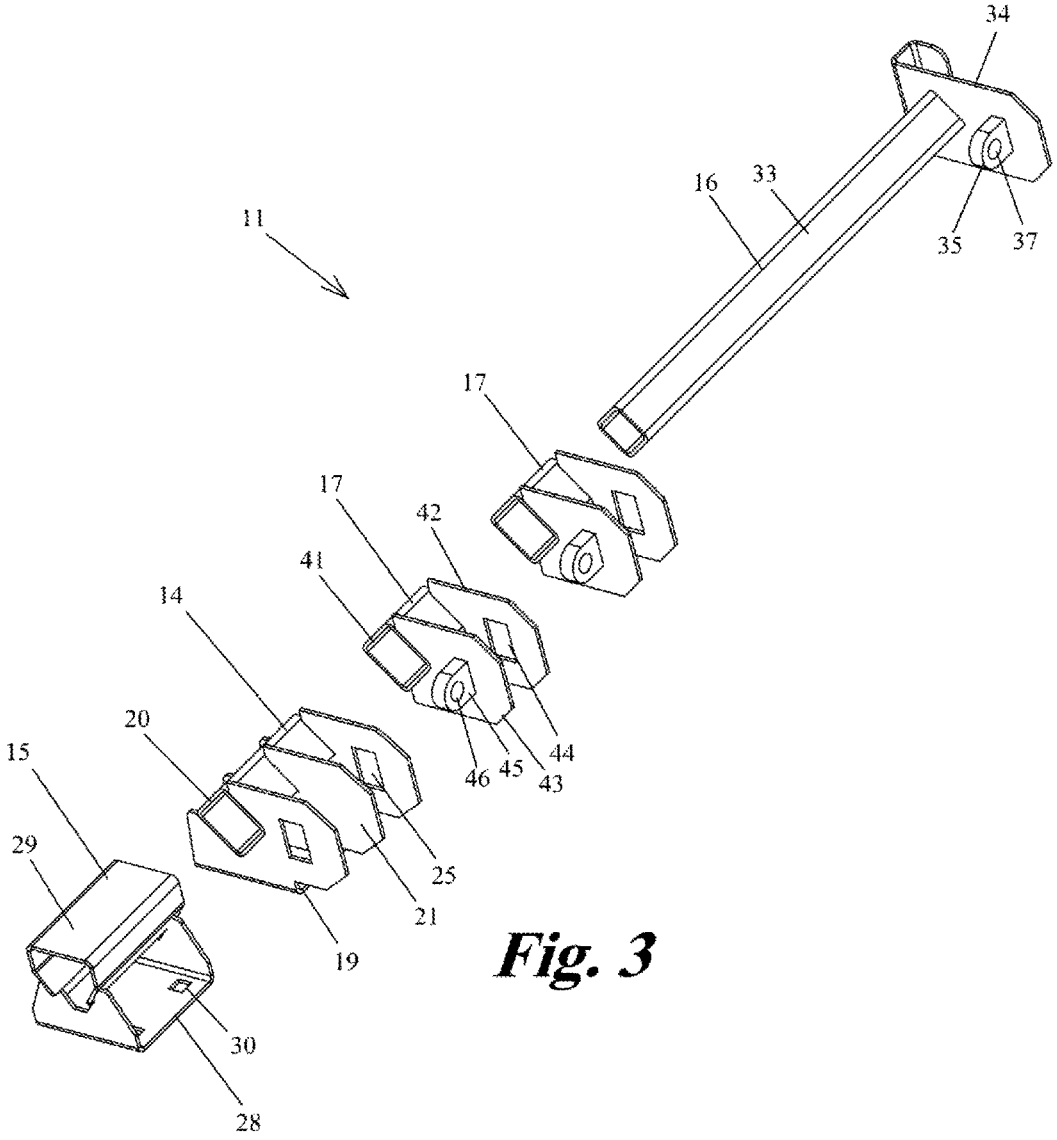
FIG. 3 is a exploded perspective view of the locking system of FIG. 1.

Referring to FIGS. 1-3, a locking system 11 embodying features of the present invention includes a base 14, a receiver 15, a bolt assembly 16 and at least one link member 17. The elements of the locking system 11 are preferably made of metal such as steel or other material that is tough and not easily cut. The base 14 has a base mounting portion 19, a base tube 20 and three laterally spaced, parallel base plates 21. The base mounting portion 19 shown is a flat plate with four spaced mounting apertures 23 in a rectangular pattern for mounting the base mounting portion 19 to a first structure 24 such as a post on a fence. The base mounting portion 19 can have other shapes and other methods of mounting the base mounting portion 19 can be used.

Describing the specific embodiments herein chosen for illustrating the invention, certain terminology is used which will be recognized as being employed for convenience and having no limiting significance. For example, the terms "front", "back", "top", "bottom", "vertical" and "horizontal" refer to the illustrated embodiments in the normal position of use. Further, all of the terminology above-defined includes derivatives of the word specifically mentioned and words of similar import.

The base tube 20 shown is a laterally opening square tube that is rigidly mounted on and projects forwardly from the base mounting portion 19 with the sides of the base tube at 45 degree angles to vertical. The base tube 20 can have other shapes, such as round or rectangular, and can be mounted at other orientations. The base plates 21 shown project downwardly from the base tube 20 with the outer base plates 21 at opposite ends of the base tube 20 and the other base plate 21 intermediate the ends of the base tube 20. A horizontally elongated slot 25, spaced below the base tube 20, extends through each of the outer base plates 21.

The receiver 15 has a receiver mounting portion 28 and a receiver tube 29. The receiver mounting portion 28 shown is a flat plate with four spaced mounting apertures 30 in a rectangular pattern for mounting the receiver mounting portion 28 to a second structure 31 such as a post on a gate. The receiver mounting portion 28 can have other shapes and other methods of mounting the receiver mounting portion 28 can be used.

The receiver tube 29 is rigidly mounted on and projects forwardly from the receiver mounting portion 28. The receiver tube 29 shown has a five sided cross section with one side angling upwardly, forwardly from the receiver mounting portion 28 to a horizontal side, another side angling downwardly, forwardly from the receiver mounting portion 28 to another horizontal side, and a vertical side extending between the two spaced horizontal sides.

The bolt assembly 16 has an elongated bolt 33 and a end plate 34. The bolt 33 is sized and shaped to slide through the base tube 20 and into the receiver tube 29. The bolt 33 shown is a square tube with an outer dimension slightly smaller than the inner dimension of the base tube 20. The bolt 33 could be a solid bar. The end plate 34 is rigidly attached to one end of the bolt 33 and projects at a 45 degree angle relative to the sides of the bolt 33, such that end plate 34 projects downwardly and is aligned with the base plates 21 when the bolt 33 is in the base tube 20.

The end plate 34 includes a padlock tab 35. The padlock tab 35 projects from the end plate 34 in the same direction as the bolt 33. The padlock tab 35 is sized and positioned on the end plate 34 to slide through and project beyond the slot 25 on the base plate 21 nearest to the end plate 34. The padlock tab 35 shown is sized fit into the slot on a puck lock 36. A padlock aperture 37 extends through the portion of the padlock tab 35 that projects beyond the slot 25. The padlock aperture 37 is sized to receive the plunger of a puck lock 36 or the shackle of a padlock 38.

Each link member 17 includes a link tube 41 and spaced, parallel first and second link plates 42 and 43. The link tube 41 is sized to slide on the bolt 33. The link tube 41 shown is a square tube the same size as the base tube 20. The first and second link plates 42 and 43 are rigidly attached to opposite ends of the link tube 41. The first and second link plates 42 and 43 project at a 45 degree angle relative to the sides of the link tube 41, such that the first and second link plates 42 and 43 project downwardly and are aligned with the base plates 21 when the link tube 41 is on the bolt 33 and the bolt 33 is in the base tube 20.

The first link plate 42 includes an elongated slot 44 having the same size and shape as the slot 25 on the base plate 21. The second link plate 43 includes a padlock tab 45 having the same size and shape as the padlock tab 35 on the end plate 34. The padlock tab 45 projects away from the first link plate 42. The padlock tab 45 of the second link plate 43 has a padlock aperture 46 of the same size and in the same location as the padlock aperture 37 on the padlock tab 35 on the end plate 34 of the bolt assembly 16.

The link members 17 are assembled onto the bolt 33, between the end plate 34 of the bolt assembly 16 and the base tube 20 of the base 14, with the padlock tabs 45 projecting towards the base 14. The slots 44 on the first link plate 42 are positioned to align with the padlock tab 35 on the end plate 34 of the bolt assembly 16. The padlock tabs 45 on the second link plates 43 are positioned to align with the slot 25 on the base plate 21 of the base 14.

The locking system 11 with a single link member 17 can receive two locks. Unlocking and removing either lock allows a user to pull the bolt 33 out of the receiver tube 29 and open the gate or door. Each addition link member 17 allows for an additional lock. The two outer base plates 21 with slots 25 allow the locking system 11 to be used with the receiver 15 on either side of the base 14. The three base plates 21 are spaced close enough to each other, and the first and second link plates 42 and 43 are spaced close enough to each other, to inhibit access to the shackle of a padlock 38.

Although the present invention has been described with a certain degree of particularity, it is understood that the present disclosure has been made by way of example and that changes in details of structure may be made without departing from the spirit thereof.

What is claimed is:

1. A multiple padlock lock system for locking a first structure to a second structure with a plurality of padlocks, comprising:

a base for mounting on said first structure, said base having a hollow base tube, a flat base plate that projects transversely from an end of said base tube, and an elongated slot through said base plate and spaced from said base tube, a receiver for mounting on said second structure, at least one link member having a hollow link tube, a first link plate that projects transversely from one end of said link tube and a spaced, parallel second link plate that projects transversely from the other end of said link tube, said first link plate including an elongated slot spaced from said link tube, said second link plate including a padlock tab spaced from said link tube and projecting away from said first link plate, said padlock tab being sized and positioned to slide through and project beyond said slot on said base plate, said padlock tab having a padlock aperture sized and positioned to receive a shackle of a padlock when said padlock tab is projecting through said slot on said base plate, and a bolt assembly having an elongated bolt and an end plate that projects transversely from one end of said bolt, said bolt being sized and shaped to extend through said link tube, said base tube and into said receiver, said end plate having a padlock tab spaced from and projecting in the same direction as said bolt, said padlock tab being sized and positioned to slide through and project beyond said slot on said first link plate, said padlock tab having a padlock aperture sized and positioned to receive a shackle of a padlock when said padlock tab is projecting through said slot on said first link plate, whereby said bolt is assembled to extend through said link tube, through said base tube and into said receiver with said padlock tab on said end plate projecting through said slot on said first link plate, said padlock tab on said second link plate projecting through said slot on said base plate and a shackle of a locked padlock in said padlock apertures on said padlock tabs on said end plate and said second link plate to lock said bolt in said receiver, and removal of any padlock allows said bolt to slide out of said receiver.

2. The lock system as set forth in claim 1 including more than one link member with said link members being assembled on said bolt between said end plate and said base tube.

3. The lock system as set forth in claim 1 wherein said base includes two spaced flat base plates that project transversely from opposite ends of said base tube, each said base plate having an elongated slot through said base plate and spaced from said base tube, whereby said receiver can be mounted on either side of said base.

4. The lock system as set forth in claim 3 wherein said base includes a third base plate spaced intermediate said base plates at opposite ends of said base tube, wherein said base plates are spaced closely enough together to inhibit access to a padlock shackle by a bolt cutter.

5. The lock system as set forth in claim 1 wherein said base tube is a square tube with an inner dimension and said bolt is a square tube with an outer dimension slightly smaller than said inner dimension of said base tube.

6. The lock system as set forth in claim 5 wherein said link tube is a square tube with an inner dimension substantially the same said inner dimension of said base tube.

7. The lock system as set forth in claim 6 wherein said base plate projects at a 45 degree angle relative to the sides of said base tube, said end plate projects at a 45 degree angle relative to the sides of said bolt, and said first and second link plates project at a 45 degree angle relative to the sides of said link tube.

8. The lock system as set forth in claim 7 wherein said base includes a base mounting portion for mounting said base on said first structure, said base mounting portion being a flat plate and said base tube rigidly mounting on said base mounting portion with the sides of said base tube at a 45 degree angle relative to said base mounting portion.

9. The lock system as set forth in claim 5 wherein said receiver includes a hollow receiver tube sized to receive said bolt.

10. The lock system as set forth in claim 9 wherein said receiver tube is a five sided tube.

11. The lock system as set forth in claim 10 wherein said receiver includes a receiver mounting portion, said receiver mounting portion being a flat plate and said receiver tube rigidly mounting on said receiver mounting portion with one side angling upwardly, forwardly from said receiver mounting portion to a horizontal side, another side angling downwardly, forwardly from said receiver mounting portion to another horizontal side, and a vertical side extending between said two spaced horizontal sides.

12. The lock system as set forth in claim 1 wherein said padlock tabs on said end plate and said second link plate are sized to fit into a slot in a puck lock and said padlock apertures in said padlock tabs on said end plate and said second link plate are sized and positioned to receive a plunger of said puck lock.

13. The lock system as set forth in claim 1 wherein said first and second link plates of said link member are spaced closely enough together to inhibit access to a padlock shackle by a bolt cutter.

14. A multiple padlock lock system for locking a first structure to a second structure with a plurality of padlocks, comprising:

a base having a base mounting portion for mounting on said first structure, a hollow base tube rigidly mounted on said base mounting portion, a flat base plate at each end of said base tube that projects transversely said base tube and has an elongated slot through said base plate and spaced from said base tube, and a third base plate that projects transversely said base tube spaced intermediate said other base plates, a receiver having a receiver mounting portion for mounting on said second structure and a hollow receiver tube rigidly mounted on said receiver mounting portion, at least one link member having a hollow link tube, a first link plate that projects transversely from one end of said link tube and a spaced, parallel second link plate that projects transversely from the other end of said link tube, said first link plate including an elongated slot spaced from said link tube, said second link plate including a padlock tab spaced from said link tube and projecting away from said first link plate, said padlock tab being sized and positioned to slide through and project beyond said slot on said base plate, said padlock tab having a padlock aperture sized and positioned to receive a shackle of a padlock when said padlock tab is projecting through said slot on said base plate, said padlock tab being sized to fit into a slot in a puck lock and said padlock aperture being sized and positioned to receive a plunger of said puck lock, and a bolt assembly having an elongated bolt and an end plate that projects transversely from one end of said bolt, said bolt being sized and shaped to extend through said link tube, said base tube and said receiver tube, said end plate having a padlock tab spaced from and projecting in the same direction as said bolt, said padlock tab being sized and positioned to slide through and project beyond said slot on said first link plate, said padlock tab having a padlock aperture sized and positioned to receive a shackle of a padlock when said padlock tab is projecting through said slot on said first link plate, said padlock tab being sized to fit into a slot in a puck lock and said padlock aperture being sized and positioned to receive a plunger of said puck lock, whereby said bolt is assembled to extend through said link tube, through said base tube and into said receiver with said padlock tab on said end plate projecting through said slot on said first link plate, said padlock tab on said second link plate projecting through said slot on said base plate and a shackle of a locked padlock in said padlock apertures on said padlock tabs on said end plate and said second link plate to lock said bolt in said receiver, and removal of any padlock allows said bolt to slide out of said receiver.

* * * * *